United States Patent [19]

Neuhöffer et al.

[11] Patent Number: 4,730,374

[45] Date of Patent: Mar. 15, 1988

[54] HEATABLE GLAZING OR CALENDERING ROLL

[75] Inventors: Hans-Friedrich Neuhöffer; Erich Vomhoff, both of Königsbronn, Fed. Rep. of Germany

[73] Assignee: Schwabische Huttenwerke, Aalen-Wasseralfingen, Fed. Rep. of Germany

[21] Appl. No.: 863,261

[22] Filed: May 13, 1986

[30] Foreign Application Priority Data

May 24, 1985 [DE] Fed. Rep. of Germany ..... 3518808

[51] Int. Cl.[4] ..... B21B 13/00

[52] U.S. Cl. ..... 29/130; 29/113 R; 29/116 R; 29/132

[58] Field of Search ..... 29/110, 130, 132, 113 R, 29/116 R; 100/170, 163 A, 163 R; 101/174, 177, 178, 181, 118

[56] References Cited

U.S. PATENT DOCUMENTS

| | | | |
|---|---|---|---|
| 1,563,216 | 11/1925 | Moog . | |
| 2,498,662 | 2/1950 | Eaby | 29/130 |
| 2,520,826 | 8/1950 | Beck | 29/113 R |
| 3,416,435 | 12/1968 | Dahl et al. | 29/130 |
| 3,950,897 | 4/1976 | Birkenstack et al. . | |
| 4,217,821 | 8/1980 | Vertegaal et al. | 29/113 R |
| 4,386,566 | 6/1983 | Moss | 29/113 R |
| 4,407,199 | 10/1983 | Moss | 29/113 R |
| 4,607,420 | 8/1986 | Vomhoff | 29/113 R |

FOREIGN PATENT DOCUMENTS

| | | |
|---|---|---|
| 1134272 | 12/1957 | Fed. Rep. of Germany . |
| 1561732 | 7/1969 | Fed. Rep. of Germany . |
| 1940175 | 8/1969 | Fed. Rep. of Germany . |
| 3014891 | 4/1980 | Fed. Rep. of Germany . |
| 3140425 | 10/1981 | Fed. Rep. of Germany . |
| 46281 | 11/1973 | Finland . |
| 283102 | 7/1970 | Sweden . |
| 283894 | 8/1970 | Sweden . |

OTHER PUBLICATIONS

Vortag, "Verbesserung des Papierprofils und der Glatte durch beheizte Glattwerk' und Kalanderwalzen", von Peter Rothenbacher.

Erich Vomhoff and Michael Zaoralek of the Haupttagung des OZEPA, Oct. 18, 1984, in Klagenfurt.

*Primary Examiner*—Howard N. Goldberg

*Assistant Examiner*—Irene Graves Golabi

[57] ABSTRACT

In a heatable glazing or calendering roll having a cylindrical hollow body with flange necks for each end of the cylindrical hollow body, a displacement body disposed in the cylindrical hollow body and supply and discharge lines for a fluid heat carrier flowing through the annular gap between the displacement body and the cylindrical hollow body, by selecting a suitable material for the flange necks and/or by corresponding thermal insulation between cylindrical hollow body and flange necks it is achieved that the flange necks on heating up of the cylindrical hollow body expand less than the cylindrical hollow body and thereby bending moments are generated in the cylindrical hollow body which counteract the oxbow deformation.

7 Claims, 5 Drawing Figures

HEATABLE GLAZING OR CALENDERING ROLL

BACKGROUND OF THE INVENTION

1. Field of the Invention

The invention relates to a heatable glazing or calendering roll comprising a cylindrical hollow body, a bearing journal for each end of the cylindrical hollow body, a displacement body disposed in the cylindrical hollow body and supply and discharge lines for a fluid heat carrier which flows through the annular gap between the displacement body and the cylindrical hollow body.

2. Description of the Prior Art

Such a roll known for example from German Offenlegungsschrift No. 3 014 891 is used in particular for making and processing paper.

The actual roll body, that is the cylindrical hollow body over which in the centre region thereof, except for the two end regions, the web material to be made or processed runs, is made from cast iron or steel, preferably chilled iron or hardened steel.

In the course of time the demands made as regards uniform thickness and the gloss of the papers important for imprintability have continuously increased, and in particular in recent years there has been a great demand for light thin papers. To obtain in these paper the same thickness deviations in percent as in the hitherto usual thicker papers, higher demands were also made of the profile of the rolls. Account has been taken of this partially by improving the geometrical form of the rolls by advances in grinding and polishing techniques so that today in the production of for example 45 g/m$^2$ paper the tolerances for the diameter of the roll lie within the $\mu$m range.

As early as the 60s investigations were made of the influence of the shape changes of glazing or calendering rolls due to axial and radial temperature differences on the roll profile and thus also on the paper profile (cf. the lecture "Improving the paper profile and the gloss by heated glazing and calendering rolls" held by Peter Rothenbacher, Erich Vomhoff and Michael Zaoralek at the main congress of the ÖZEPA on Oct. 18, 1984 in Klagenfurt). If in accordance with a usual rule of thumb for a temperature change of 1° C. and a reference length of 1000 mm a diameter change of about 10 $\mu$m is assumed, a temperature change of 4° C. with a roll having a rated diameter of 710 mm manifests itself in an increase in the diameter of 15 $\mu$m. Even by extremely careful polishing work such a deviation cannot be compensated.

These temperature fluctuations and the resulting form changes can also not be kept under control by careful setting of the temperature of the fluid heat carrier, for example water, steam or oil, so that difficulties are always encountered in this respect.

A further problem resides in that cylindrical bodies cast from iron consist in their outer region of soft cast iron and in their inner region of grey cast iron. These two materials combined to form a unitary cylindrical hollow body have different thermal properties so that both the greater thermal expansion at higher temperatures in the inner region compared with the outer colder shell of the soft cast iron and the bimetal effect due to the different thermal expansion of the wear-resistant outer zone compared with the grey cast iron core in the inner region lead to elastic deformations in the edge region of the cylindrical hollow body and thus of the roll. At some distance from the edge region the roll contracts whilst at the camber end itself a widening takes place. Because of this typical form of the change in shape this phenomenon is referred to as "oxbow effect". This oxbow edge effect in heated calendering rolls can be influenced by appropriately formed thermal insulation of the roll edges as known from German Offenlegungsschrift No. 3 140 425.

More exact investigations have however shown that the known features for compensating the oxbow effect are not adequate, i.e. deformations of the cylindrical hollow body still occur, particularly in the edge region, which far exceed the admissible tolerance fluctuations and have corresponding effects on the quality of the web materials made.

SUMMARY OF THE INVENTION

Therefore, the invention has an object to provide a heatable glazing or calendering roll of the type set forth above in which the aforementioned disadvantages do not occur.

More particularly it is intended to provide a heatable glazing or calendering roll which in constructionally simple manner largely compensates the oxbow effect and thus ensures an extremely high constancy of the diameter of the roll over its entire length, including its edge regions.

The invention proposes a heatable glazing or calendering roll comprising a cylindrical hollow body, a bearing journal for each end of the cylindrical hollow body, a displacement body disposed in the cylindrical hollow body and supply and discharge lines for a fluid heat carrier which flows through the annular gap between the displacement body and the cylindrical hollow body in which the bearing journals heat up on warming up of the cylindrical hollow specifically in relationship to the cylindrically hollow body, deform during said warm up and thereby generate in the cylindrical hollow body bending moments opposing the oxbow deformation.

Convenient further developments of the invention are defined by the features of the subsidiary claims.

The advantages achieved with the invention are based on the following considerations: The oxbow effect of the cylindrical hollow body is due to the influences of the thermal properties of the cylindrical hollow body which lead in turn to corresponding deformations and thus to different diameters of the hollow body considered over the entire length thereof. If by appropriate constructional steps which will be discussed in detail hereinafter it is ensured that the flange necks of the cylindrical hollow body expand specifically when said body is heated, i.e. the flange necks or bearing journals assume due to the heating a form such that by cooperation between the slightly deformed flange necks on the one hand and the greatly heated and thus highly deformed cylindrical hollow body on the other hand bending moments are generated which lead to corresponding stresses in the cylindrical hollow body and thus counteract the oxbow deformation of the cylindrical hollow body. By appropriate matching of the various influencing parameters the oxbow effect can thus be compensated and the diameter change of the cylindrical hollow body caused thereby reduced to a negligible value.

To obtain the desired specific deformation of the two bearing necks there are fundamentally two techniques available, i.e.

(a) the use of a material for the flange necks which has a smaller coefficient of thermal expansion than the cylindrical hollow body, or (b) the specific thermal insulation of the flange necks with respect to the cylindrical hollow body or the heat carrier to produce a corresponding specific deformation of the flange necks.

As model calculations have shown with a cylindrical hollow body cast in iron a substantial compensation of the oxbow effect can be achieved if the bearing necks for example have a coefficient of thermal expansion of less than $11\times10^{-6}$ (1/°C.). The literature describes nodular cast iron or steel types with such a low coefficient of thermal expansion, coefficients of thermal expansion of the order of magnitude of $10\text{–}10.5\times10^{-6}$ (1/°C.) being mentioned for the temperature range from 0° to 150° C.

Although for many uses the use of a corresponding material for the flange necks is itself sufficient to compensate the oxbow effect, such a material is preferably combined with a specific thermal insulation of the flange necks, i.e. the cylindrical end faces of the flange necks on the one hand and the cylindrical hollow body on the other are insulated with respect to each other in such a manner that the heat flow from the cylindrical hollow body to the flange necks has a predetermined value and thus leads to a defined heating and deformation of the flange necks. Appropriate annular or disc-shaped thermal insulating elements may for example be made from polytetrafluoroethylene. In the gap between the flange necks on the one hand and the cylindrical hollow body on the other for various reasons direct contact metal/metal is necessary. Here the specific thermal insulation can be achieved for example in that chamber-shaped thermal insulating elements or strip-shaped contact surfaces metal/metal are employed.

For thermal insulation of the flange neck with respect to the traversing heat carrier a tubular thermal insulating element is employed inserted into the corresponding supply and discharge line in the flange neck.

BRIEF DESCRIPTION OF THE DRAWINGS

The invention will be explained in detail hereinafter with reference to an example of embodiment with the aid of the attached schematic drawings, wherein.

DESCRIPTION OF THE PREFERRED EMBODIMENTS

Figure 1:
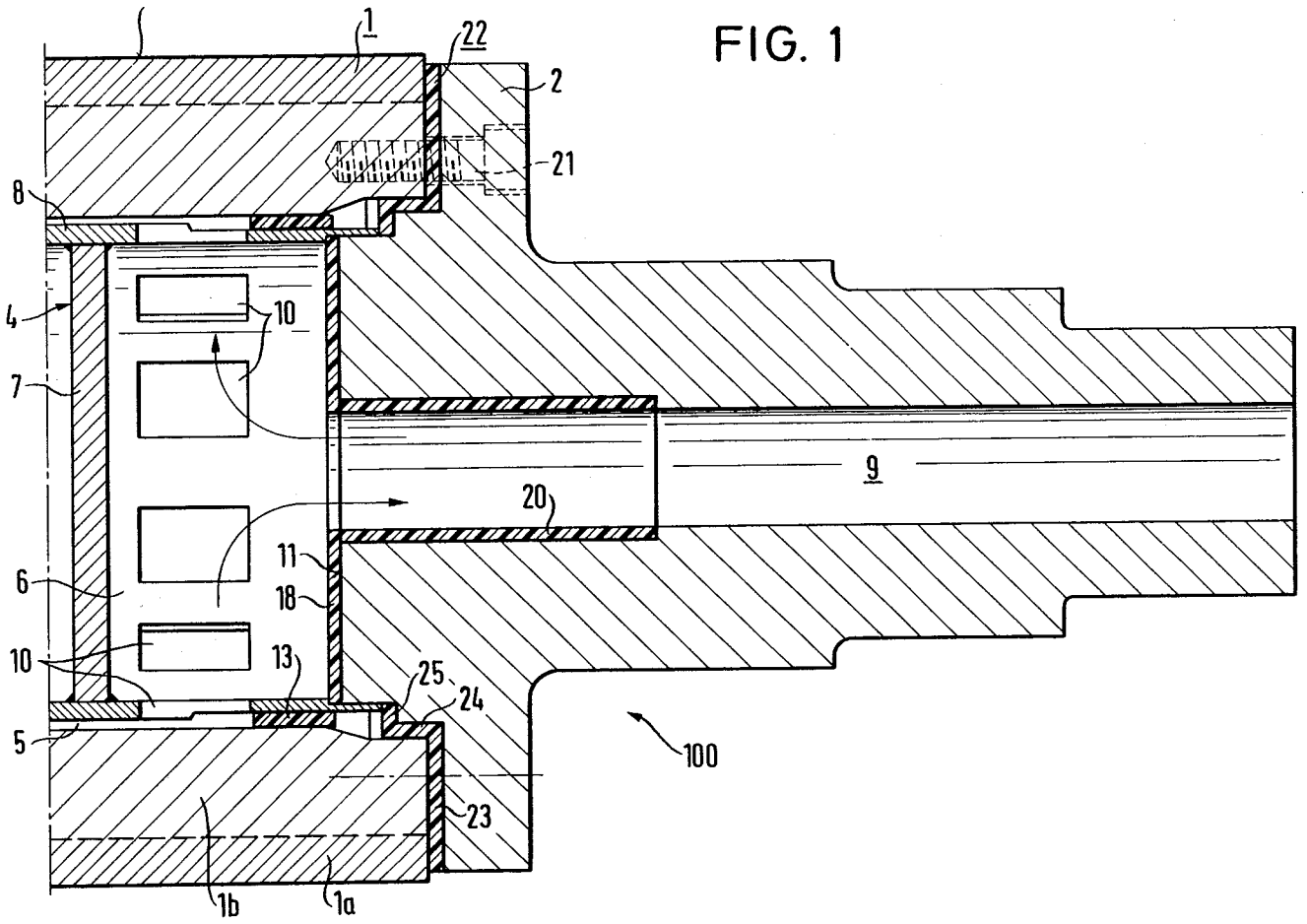
FIG. 1 is a section through the edge region of a heatable glazing or calendering roll according to the invention and FIGS. 2, 3, 4 and 5 show various embodiments of the thermal insulation.

The heatable glazing and calendering roll illustrated in the Figure and designated generally by the reference numeral 100 comprises a cylindrical hollow body 1 which is cast in iron or steel and which at its two ends (in FIG. 1 only the right end is shown) is mounted by flange journals or necks 2. The flange necks 2 are screwed in the usual manner to the corresponding end wall of the cylindrical hollow body 1 and centered in a turned-out recess at the end of the cylindrical hollow body 1 with an appropriate projection. The rigid connection fixed in rotation between the flange neck 2 and cylindrical hollow body 1 is effected by a plurality of screws which are distributed at equal angular intervals over the periphery of the roller 100, one screw 21 being indicated in FIG. 1.

Although it is made from the same material, that is cast iron, a distinction must be made between two regions in the hollow cylindrical body 1, that is the outer shell 1*a* comprising a soft wear-resistant cast iron with a coefficient of thermal expansion of about $8.8\times10^{-6}$ (1/°C.) and a radially inner region 1*b* of a grey cast iron having a coefficient of thermal expansion of about $12\times10^{-6}$ (1/°C.). As an alternative, a hardened steel may be used whose outer shell 1*a* consists of a hardened martensitic steel having a certain coefficient of thermal expansion whilst the inner region 1*b* has a different coefficient of thermal expansion.

The hollow space between the flange necks 2 and the cylindrical hollow body 1 is filled out except for a narrow annular gap 5 by a displacement body 4 which at its two ends between the flange neck 2 and its end wall 7 leaves free a substantially drum-shaped flow chamber 6 in each case.

The displacement body 4 consists of a steel tube 8 which is thin compared with the cylindrical body 1 and which with its two ends, as shown in the drawings, is centered on a corresponding projection of the flange neck 2. In the axial direction the sheet metal cylinder 8 of the displacement body 4 engages with the clearance necessary in practice against the end face of the flange neck 2. The steel tube 8 is welded to two circular sheet metal discs 7 forming the end walls of the displacement body 4. The sheet metal discs 7 are spaced from the end face of the flange neck 2 on the left in the illustration of FIG. 1 such a distance that they leave free between themselves and said end face the aforementioned drum-shaped flow chamber 6. In FIG. 1 an upper arrow indicates the entry of the fluid heat carrier, i.e. steam, water or oil, whilst the lower arrow indicates the flow path at the other roll end where the flow leaves the roll 100. To ensure that the flow can pass from a passage 9 centrally traversing the flange neck 2 through the flow chamber 8 into the annular gap between the displacement body 4 and the cylindrical hollow body 1, in the portion of the cylindrical hollow body 8 projecting beyond the end wall 4 windows 10 are cut through which the fluid heat carrier can flow. At the other end said roll 100 has a similar construction.

The width of the web to be treated with the roll 100, for example a paper web, is indicated at the top of the Figure and designated "web width".

When using such a roll 100 a fluid heat carrier which can have a temperature of about 100°–150° C. flows through the passage 9 into the interior of the cylindrical hollow body 1, the latter being correspondingly heated up. Two effects lead to elastic deformations of the cylindrical hollow body 1 in its two edge regions, i.e. firstly the greater thermal expansion of the inner region 1*b* at higher temperatures compared with the outer colder shell 1*a* and secondly the bimetal effect caused by the different thermal expansion of the wear-resistant outer zone 1*a* compared with the grey cast iron core 1*b*. Consequently, at some distance from its edges the cylindrical hollow body 1 contracts somewhat whilst at the camber end itself an expansion takes place. Due to the typical form of this shape change of the cylindrical hollow body the term "oxbow effect" is used which in conventional rolls can lead to changes in the radius of the cylindrical hollow body of more than 40 μm, i.e. diameter fluctuations which in turn lead to a corresponding change in the thickness of the paper being processed.

To compensate this oxbow effect of the cylindrical hollow body 1 firstly each flange neck or journal 2 is made from a special material having a coefficient of thermal expansion less than $11\times10^{-6}$ (1/°C.). Particularly suitable are materials which have in the temperature range from 0° C.–150° C. a coefficient of thermal expansion of $10\text{–}10.5\times10^{-6}$ (1/°C.). Such materials are described in the literature as nodular or spherical cast iron or special steels.

This extremely low coefficient of thermal expansion of the material for the flange necks 2 leads on heating of the cylindrical hollow body 1 to the flange necks 2 expanding only in a predetermined relationship with respect thereto; as a result, in conjunction with the comparatively pronounced expansion of the cylindrical hollow body 1 bending moments and thus stresses are generated which counteract the oxbow effect and on appropriate adaptation of the coefficients of thermal expansion of the cylindrical hollow body to the coefficient of thermal expansion of the flange necks 2 lead to a deformation "zero" of the cylindrical hollow body 1, as has been shown theoretically and experimentally.

A second constructional solution resides in that at all engagement faces between flange necks 2 and cylindrical hollow body 1 thermal insulation layers are provided. For this purpose, a thermal insulating ring is arranged in the region between the inner surface of the cylindrical hollow body 1 and the outer surface of the casing 8 of the displacement body between the windows 10 on the one hand, which are disposed in the projecting regions of the cylinder 8 axially spaced from the end face 11 of the flange neck 2, and the end face 11 of the flange neck 2 on the other hand. This thermal insulating ring 13 has the form of a cylindrical ring and at least substantially fills the gap between the inner surface of the cylindrical hollow body 1 and the outer surface of the cylinder 8 correspondingly turned in this region. Its axial extent in the embodiment illustrated is about two-thirds of the portion of the cylindrical hollow body 1 projecting over the web width at the roll end illustrated. The thermal insulating ring 13 consists of an adequately heat-resistant and water-resistant plastic, such as polytetrafluoroethylene, which also exhibits adequate thermal insulation. As regards the choice of the optimum material it is essential that said material withstands the thermal stresses occurring and moreover has a substantially smaller thermal conductivity than the material of the cylindrical hollow body 1.

As further apparent in FIG. 1 a considerable heat transfer from the passage 9 and the drum-shaped flow chamber 6 can take place through the corresponding surfaces of the flange neck 2 and from the latter into the cylindrical hollow body 1. To prevent this heat transfer the surface of the flange neck 2 facing the flow chamber 6 is covered with a plate 18 of thermal insulation material, for example a corresponding plastic. The plate 18 may for example be screwed on or stuck on.

For the same purpose the lining of the flow passage 9 shown in FIG. 1 with an envelope 20 of thermally insulating plastic is provided which is inserted into a corresponding turned out recess of the flange neck and also secured for example by means of a pin against axial displacement.

Radially outwardly adjoining the inner thermal insulation by the elements 13, 18 and 20 is a thermal insulation 22 which comprises an annular base body 23, a short tubular extension 24 and a radially inwardly projecting projection 25. This thermal insulation is disposed between the radially outer engagement surfaces of the cylindrical hollow body 1 and the flange necks 2.

Thus, as a whole the various thermal insulation elements have the effect of partially selectively preventing the heat transfer between the flange necks 2 on the one hand and the cylindrical hollow body 1 or heat carrier on the other, i.e. the flange necks 2 heat up and deform only in a specific relation to the heating and deformation of the cylindrical hollow body so that the same function is achieved as with a material of low coefficient of thermal expansion for the flange necks 2, i.e. no free oxbow bending can occur; this adapted deformation of the flange necks thus compensates in conjunction with the deformations of the cylindrical hollow body 1 the oxbow effect under heating so that the diameter of the cylindrical hollow body 1 remains extremely constant over the entire length thereof.

The two constructional steps described, i.e. a material of low coefficient of thermal expansion for the flange necks and/or specific thermal insulation and thus specific heating/deformation of the flange necks, may be used on their own or in combination, the combination having advantages in so far as it facilitates adaptation to the thermal properties of the cylindrical hollow body 1.

Figure 2:
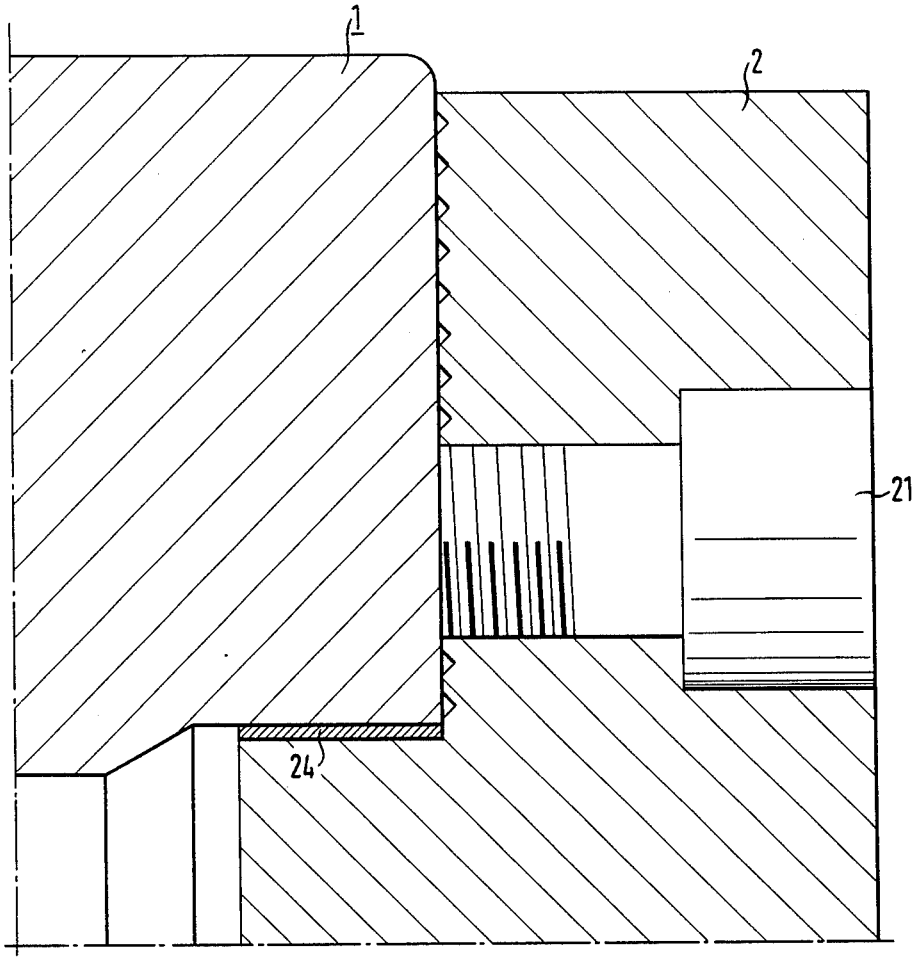

It has been proved by model calculations that the matching of the various parameters, i.e. the thermal insulation on the one hand and the coefficients of thermal expansion of the material of the flange necks on the other, can lead not only to complete compensation of the oxbow effect but in the extreme case even to a reduction of the diameter of the cylindrical hollow body 1 in the edge regions in spite of heating to about 100° C. In the embodiment described hitherto thermal insulation elements, for example annular discs, tubes or sleeves of a thermal insulation material, for example polytetrafluoroethylene, have been mentioned. However, a corresponding thermal insulation can also be achieved in that the contact face between cylindrical hollow body 1 and flange necks 2 is reduced. For this purpose, for example, the corresponding engagement surfaces can be provided with grooves tapering to a point, resulting in only strip-shaped metal/metal contact areas (cf. FIGS. 2 and 3); the heat transfer can also be set appropriately in this manner.

Figure 3:
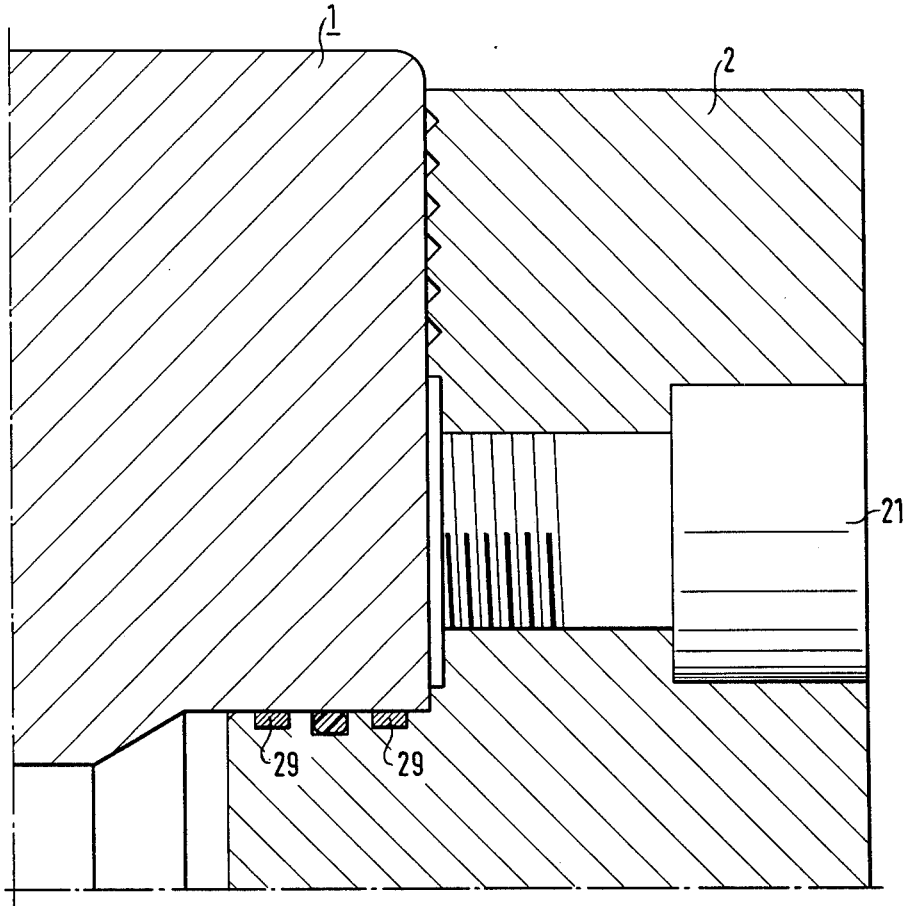
Figure 4:
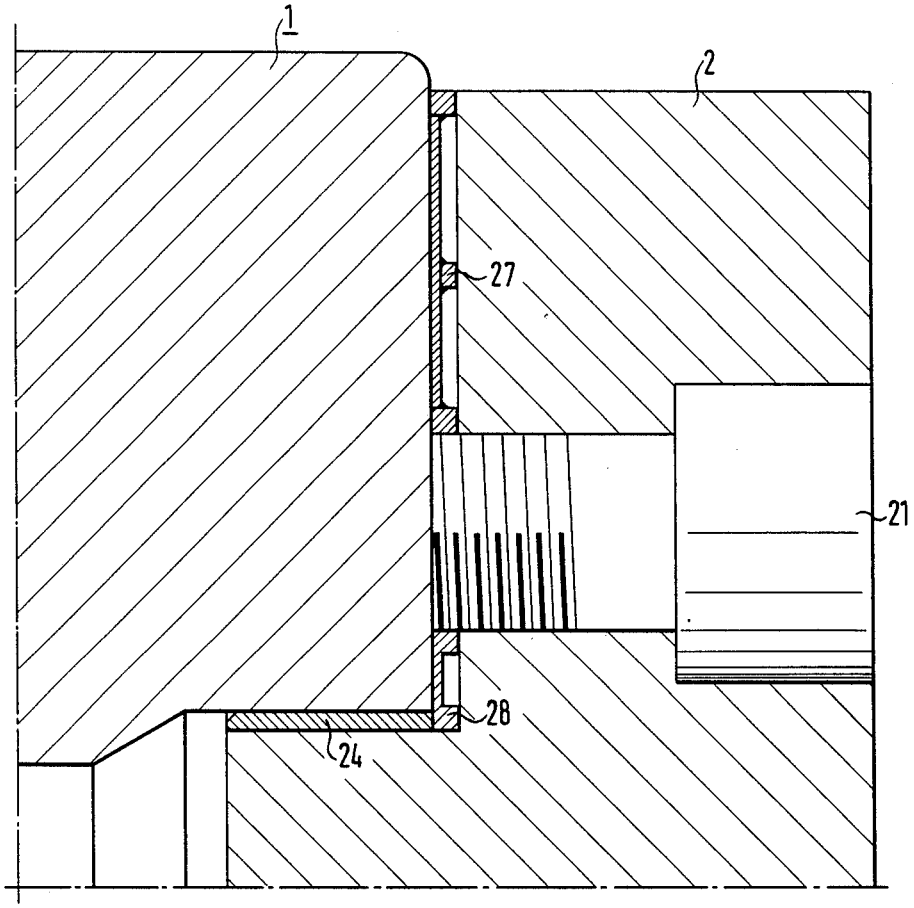
Figure 5:
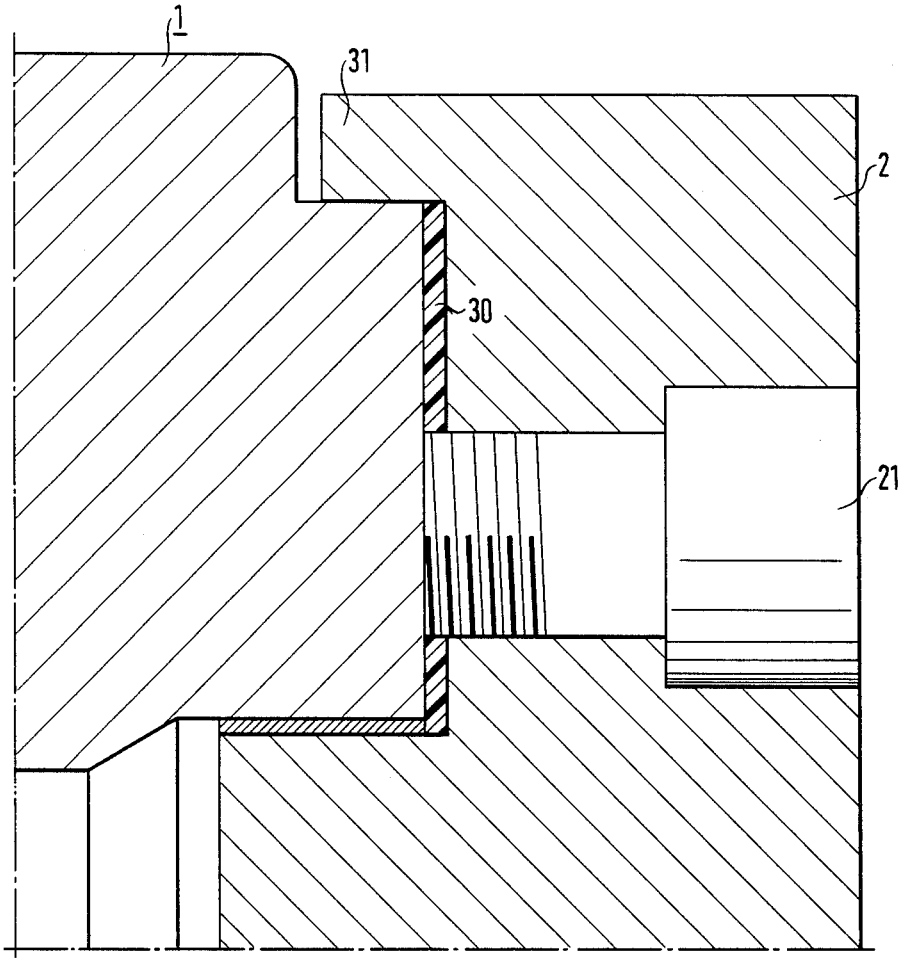

Finally, it is possible to dispose chamber-shaped or cavityforming thermal elements 27, 28, 29 between the respective engagement faces (FIGS. 3, 4).

All these steps lead to a specific increase or reduction in the contact areas between cylindrical hollow body and flange necks and also permit adjustment of the heat flow and thus effectively of the deformation of the flange necks 2, leading in turn to compensation of the oxbow effect. In the gap between the direct engagement faces of the cylindrical hollow body 1 and flange necks 2 for various reasons direct metal/metal contact is necessary so that here either chamber-shaped thermal insulation elements 27, 28 consisting of metal (cf. FIG. 4) or strip-shaped contact areas (cf. FIGS. 2 and 3) must be provided.

Such strip-shaped contact areas can also be provided at the radial contact faces between cylindrical hollow body 1 and flange necks 2 as indicated in FIG. 3 at 29.

If the desired thermal insulation is not guaranteed by air cushions, in the gap between the end face of the flange neck 2 and the end face of the cylindrical hollow body 1 an insulation disc 30 of hard plastic may be disposed. To take up the radial forces a collar 31 is provided at the outer edge of the end face of the flange neck 2 and surrounds a corresponding recess in the end face of the cylindrical hollow body 1. This collar 31 is fitted without clearance.

We claim:

1. A heatable glazing or calender roll comprising a cylindrical hollow body, a bearing journal for each end of said cylindrical hollow body, each bearing journal adapted to be secured for rotation at one end of said body and formed of metal having a coefficient of thermal expansion less than the coefficient of thermal expansion of said cylindrical hollow body, a displacement body disposed in said cylindrical hollow body and defining an annular gap between said cylindrical hollow body and said displacement body, supply and discharge lines for a fluid heat carrier which flows through said bearing journals and said annular gap between said displacement body and said cylindrical hollow body causing the temperature of said bearing journals and said cylindrical hollow body to increase with the lesser rate of radial expansion of said bearing journals secured at each end of said cylindrical hollow body generating bending moments opposing a greater rate of radial expansion at the ends of said cylindrical hollow body.

2. A heatable glazing or calendering roll according to claim 1, wherein the bearing journals consist of a material having a coefficient of thermal expansion less than $11\times10^{-6}$ (1/°C.).

3. A heatable glazing or calendering roll according to claim 2 wherein the bearing journals consist of a material having a coefficient of thermal expension of 10 to $10.5\times10^{-6}$ (1/°C.) in the temperature range between 0° to 200° C.

4. A heatable or calendering roll according to claim 1 wherein the bearing journals consist of nodular cast iron or steel types having a corresponding coefficient of thermal expansion.

5. A heatable glazing or calendering roll according to claim 1 wherein each of said bearing journals includes at least one surface facing an opposing surface of said cylindrical hollow body and at least one additional surface radially inward of said opposing surfaces partially defines one of said supply and discharge lines, thermal insulation between all of said bearing journal surfaces facing an opposing surface of said cylindrical hollow body and all of said additional bearing journal surfaces radially inward of said opposing surfaces and partially defining one of said supply and discharge lines are provided with thermal insulating linings.

6. A heatable glazing or calendering roll according to claim 5 wherein a hard insulation disc of plastic is disposed between the end face of the bearing journal and the end face of the cylindrical hollow body.

7. A heatable glazing or calandering roll according to claim 6 wherein the end face of the bearing journal is provided with a collar engaging around the cylindrical hollow body.

* * * * *